US011134784B2

(12) United States Patent
Gu et al.

(10) Patent No.: US 11,134,784 B2
(45) Date of Patent: Oct. 5, 2021

(54) HEAD RESTRAINT

(71) Applicant: Guangzhou Huashi Furniture Manufacturing Co., Ltd., Guangdong Province (CN)

(72) Inventors: Yingdong Gu, Gongzhuling (CN); Feng Chen, Lianzhou (CN)

(73) Assignee: GUANGZHOU HUASHI FURNITURE MANUFACTURING CO., LTD., Guangdong Province (CN)

( * ) Notice: Subject to any disclaimer, the term of this patent is extended or adjusted under 35 U.S.C. 154(b) by 0 days.

(21) Appl. No.: 16/835,394

(22) Filed: Mar. 31, 2020

(65) Prior Publication Data

US 2021/0127838 A1 May 6, 2021

(30) Foreign Application Priority Data

Nov. 6, 2019 (CN) ..... 201911075074.0

(51) Int. Cl.
*A47C 7/38* (2006.01)

(52) U.S. Cl.
CPC ..... *A47C 7/38* (2013.01)

(58) Field of Classification Search
CPC .. A47C 7/38; A47C 7/36; A47C 7/383; A47G 9/10; A47G 9/1009; A47G 9/1081; A47G 9/109; A61G 7/072; A61G 13/121
USPC ..... 297/410
See application file for complete search history.

(56) References Cited

U.S. PATENT DOCUMENTS 392,212 A * 11/1888 McCollum ..... A47C 7/383 297/393
3,877,751 A * 4/1975 Rasmussen ..... A61G 15/125 297/410
4,285,081 A * 8/1981 Price ..... A47C 7/383 297/391
5,337,760 A * 8/1994 Nichols ..... A61B 6/0421 128/DIG. 15
5,827,584 A * 10/1998 Akao ..... C08L 53/00 428/35.7
6,397,415 B1 * 6/2002 Hsieh ..... A47G 9/1027 5/636
6,460,207 B1 * 10/2002 Papay ..... A47G 9/1009 5/603
6,786,554 B1 * 9/2004 Zahiri ..... B60N 2/882 297/393
7,089,613 B2 * 8/2006 Cohen ..... A47C 20/026 5/622

(Continued)

*Primary Examiner* — Shin H Kim
(74) *Attorney, Agent, or Firm* — McClure, Qualey & Rodack, LLP

(57) ABSTRACT

The head restraint disclosed in the invention comprises a first bracket, a second bracket, and an elastic pillow back arranged side by side. The first bracket is connected to one side of the elastic pillow back, and the second bracket is connected to the other side of the elastic pillow back. The elastic pillow back is made of soft plastic, which gives a cushioned and comfortable feeling to the relying head. The first bracket or/and the second bracket is/are fixed to the chair back, and the second bracket can slide relative to the first bracket and adjust the length of the elastic pillow back from top to bottom, so as to meet the requirements for the comfort of head restraint for people of different heights and different levels. The invention has the advantages of simple structure and novel design.

9 Claims, 5 Drawing Sheets

(56) References Cited

U.S. PATENT DOCUMENTS

D543,717 S * 6/2007 Chen ..... D6/366
7,263,733 B2 * 9/2007 Fujita ..... A61B 6/0421 5/601
7,303,232 B1 * 12/2007 Chen ..... A47C 7/38 297/284.7
7,451,507 B2 * 11/2008 Brinkerhoff ..... A61G 13/12 5/637
7,981,068 B2 * 7/2011 Thorgilsdottir ..... A61F 5/055 602/18
D653,062 S * 1/2012 Sparshott ..... D6/716.5
8,360,066 B2 * 1/2013 Piontek ..... A61G 13/12 128/857
8,418,293 B2 * 4/2013 Tansingco ..... B60N 2/882 5/636
8,640,289 B2 * 2/2014 Reeder, Jr. ..... A47D 13/08 5/640
9,021,636 B2 * 5/2015 Schwingendorf ..... B60N 2/882 5/636
9,533,607 B2 * 1/2017 Uebelacker ..... B60N 2/22
9,615,682 B1 * 4/2017 Maddocks ..... B60N 2/80
9,622,901 B2 * 4/2017 Schwingendorf ..... A61F 5/3707
D844,154 S * 3/2019 Kellock ..... D24/190
D844,155 S * 3/2019 Kellock ..... D24/190
10,238,215 B2 * 3/2019 Peterson ..... A47C 31/023
D862,713 S * 10/2019 Wendling ..... D24/191
10,647,433 B1 * 5/2020 Vandewall ..... A61B 5/02055
2001/0040401 A1 * 11/2001 Lin ..... B60N 2/885 297/397
2004/0106732 A1 * 6/2004 Tsuji ..... C08L 53/00 525/94
2005/0177946 A1 * 8/2005 Riley ..... A61G 13/12 5/638
2006/0208544 A1 * 9/2006 Kassai ..... A47D 15/008 297/216.11
2010/0038949 A1 * 2/2010 Liao ..... A47C 7/38 297/408
2010/0147313 A1 * 6/2010 Albrecht ..... A61G 13/12 128/845
2011/0225736 A1 * 9/2011 Schwingendorf ..... B60N 2/882 5/652
2011/0316318 A1 * 12/2011 Yamaguchi ..... B60N 2/002 297/410
2012/0007399 A1 * 1/2012 Jaranson ..... B60N 2/66 297/284.4
2012/0139321 A1 * 6/2012 Wu ..... A47C 7/38 297/391
2013/0154325 A1 * 6/2013 Carlin ..... B60N 2/0284 297/284.4
2014/0077540 A1 * 3/2014 Peterson ..... A47C 7/386 297/220
2015/0157130 A1 * 6/2015 Kellock ..... A47C 7/38 5/636
2015/0272771 A1 * 10/2015 O'Brien ..... A61G 13/1265 128/847
2016/0037929 A1 * 2/2016 Wu ..... A47C 7/40 297/408
2016/0270567 A1 * 9/2016 Hsu ..... A47C 7/383
2016/0374473 A1 * 12/2016 Wu ..... A47C 7/38 297/410
2018/0103765 A1 * 4/2018 Chen ..... A47C 7/383
2018/0250183 A1 * 9/2018 Zwierstra ..... A61B 5/1127
2018/0289183 A1 * 10/2018 Karl ..... A47G 9/1009
2020/0146452 A1 * 5/2020 Chen ..... A47C 7/38
2020/0216668 A1 * 7/2020 Bruce ..... C08L 83/04
2020/0359799 A1 * 11/2020 Hafsteinsson ..... A47C 16/025
2020/0383816 A1 * 12/2020 Erdogan ..... A61H 1/00

* cited by examiner

HEAD RESTRAINT

TECHNICAL FIELD

The invention relates to the technical field of tables and chairs in furniture, in particular to a head restraint.

TECHNICAL BACKGROUND

In the prior art, the head restraint is covered with a sponge or hard plastic in soft cloth, which has the following defects: First, the head restraint is relatively hard, and its users feel uncomfortable when leaning against it; second: the length and bending of the head restraint cannot be adjusted, and the contact area between the head restraint and the head cannot be changed to meet more sitting posture requirements. Also, the bending of the head restraint and the bending of the neck pillow are different after all. If the bending of the head restraint cannot be adjusted, the head restraint cannot be used to replace the neck pillow.

SUMMARY OF INVENTION

The purpose of the invention is to overcome the disadvantages and deficiencies of the prior art and to provide a soft plastic head restraint with adjustable length and bending.

The purpose of the invention is realized through the following technical scheme: A head restraint comprises: a first bracket, a second bracket, and an elastic pillow back arranged side by side. The first bracket is connected to one side of the elastic pillow back, and the second bracket is connected to the other side of the elastic pillow back. The elastic pillow back is made of soft plastic, and the first bracket or/and the second bracket is/are fixed on the chair back.

In the above embodiment, the second bracket can slide relative to the first bracket and adjust the length of the elastic pillow back.

In the above embodiment, the materials of the elastic pillow back include PVC, ABS, lead stearate, thermoplastic polyurethane elastomer, photocatalyst, nano-silver and compatibilizer.

In the above embodiment, the proportions of the PVC, ABS, lead stearate, thermoplastic polyurethane elastomer, photocatalyst, nano-silver and compatibilizer are 1:0.1:0.45:2:0.01:0.2:3 respectively.

The manufacturing method of the elastic pillow back is as follows:

I. Put 1 portion of PVC, 0.1 portion of ABS and 3 portions of compatibilizer into a blender and stir to form a mixture;

II. Add 2 portions of thermoplastic polyurethane elastomer to the above mixture;

III. Add 0.45 portion of lead stearate and 0.01 portion of photocatalyst to the mixture formed in step 2;

IV. Plate the outside of the mixture formed in step 3 with nano-silver and finally form the shape.

Preferably, an intermediate bracket is provided between the first bracket and the second bracket. The intermediate bracket is fixed on the first bracket, the second bracket is slidably connected with the intermediate bracket, the first bracket has a fixed tab passing through the intermediate bracket, and the second bracket has the first through holes to be buckled with the tab.

In the above embodiment, a movable slot of the second bracket is provided in the middle of the intermediate bracket, two inserted plates are respectively provided on the inner side of the movable slot, and the two sides of the second bracket are respectively provided with a movable groove for the inserted plates.

In the above embodiment, an avoidance space is formed between the first bracket and intermediate bracket for engaging the chair back, and the intermediate bracket are provided with two parallel slots on the sides of the avoidance space.

In the above embodiment, the intermediate bracket is also provided with two second through holes, and the second bracket is provided with a vertical groove corresponding to the second through holes respectively.

In the above embodiment, the head of the tab is spherical and a spring is provided inside the head.

In a preferred embodiment, three steps are provided in the place where the elastic pillow back is in contact with the second bracket. The top of the three steps is provided with a row of clamping slots, the elastic pillow back is provided with fitting steps corresponding to the three steps, and the ceiling of the fitting steps is provided with a projection corresponding to the clamping slot.

Compared with the prior art, the present invention has the following advantages and effects:

First, the elastic pillow back is made of soft plastic, which is elastically stretchable, giving a cushioned and comfortable feeling to the relying head. Also, the first bracket is fixed on the chair back, the height of elastic pillow back can be adjusted by adjusting the height of the entire chair back, and the second bracket can slide relative to the first bracket and adjust the length and expansion of the elastic pillow back, so as to meet the requirements for the comfort of head restraint for people of different heights and different levels.

Second, the materials of the elastic pillow back include PVC, ABS, lead stearate, thermoplastic polyurethane elastomer, photocatalyst, nano-silver and compatibilizer. While improving elasticity and tensile properties, it has bactericidal and anti-oxidant effects.

DESCRIPTION OF DRAWINGS

1—First bracket; 2—Elastic pillow back; 3—Second bracket; 4—Intermediate bracket; 5—Tab; 6—First through hole; 7—Movable slot; 8—Inserted plate; 9—Movable groove; 10—Avoidance space; 11—Slot; 12—Second through hole; 13—Three steps; 14—Clamping slot; 15—Fitting steps; 16—Projection.

SPECIFIC EMBODIMENTS

The present invention is described in further detail below with reference to the embodiments and the accompanying drawings, but the embodiments of the present invention are not limited thereto.

Figure 1:
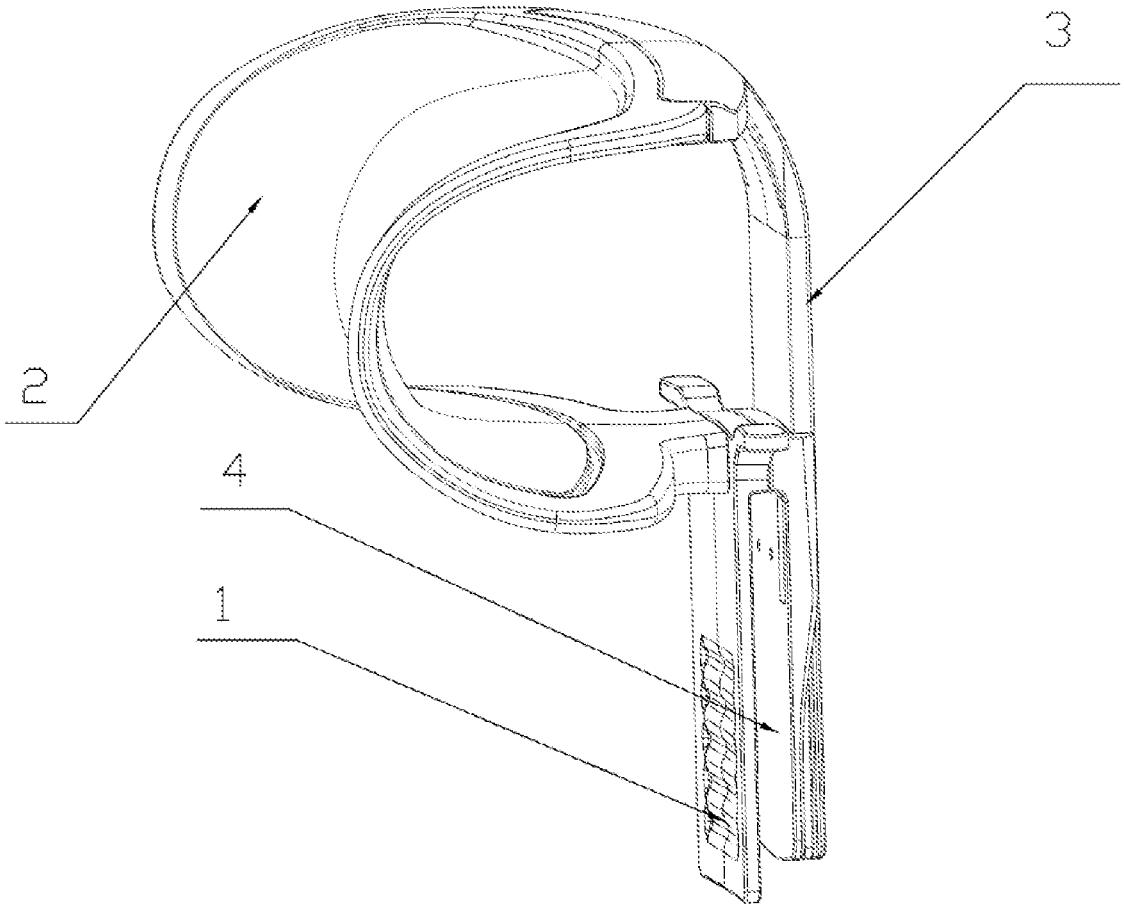
FIG. 1 is the overall structural view of head restraint.
Figure 2:
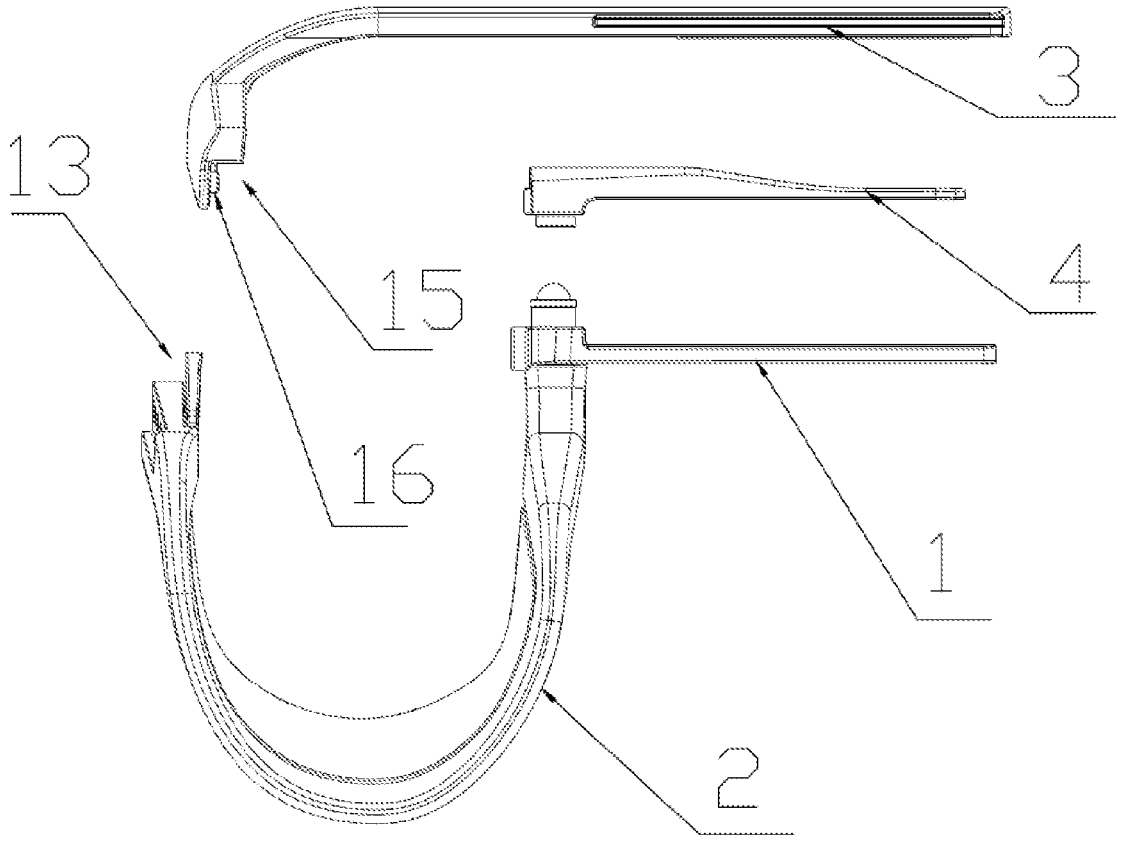
FIG. 2 is the breakdown side view of head restraint.
Figure 3:
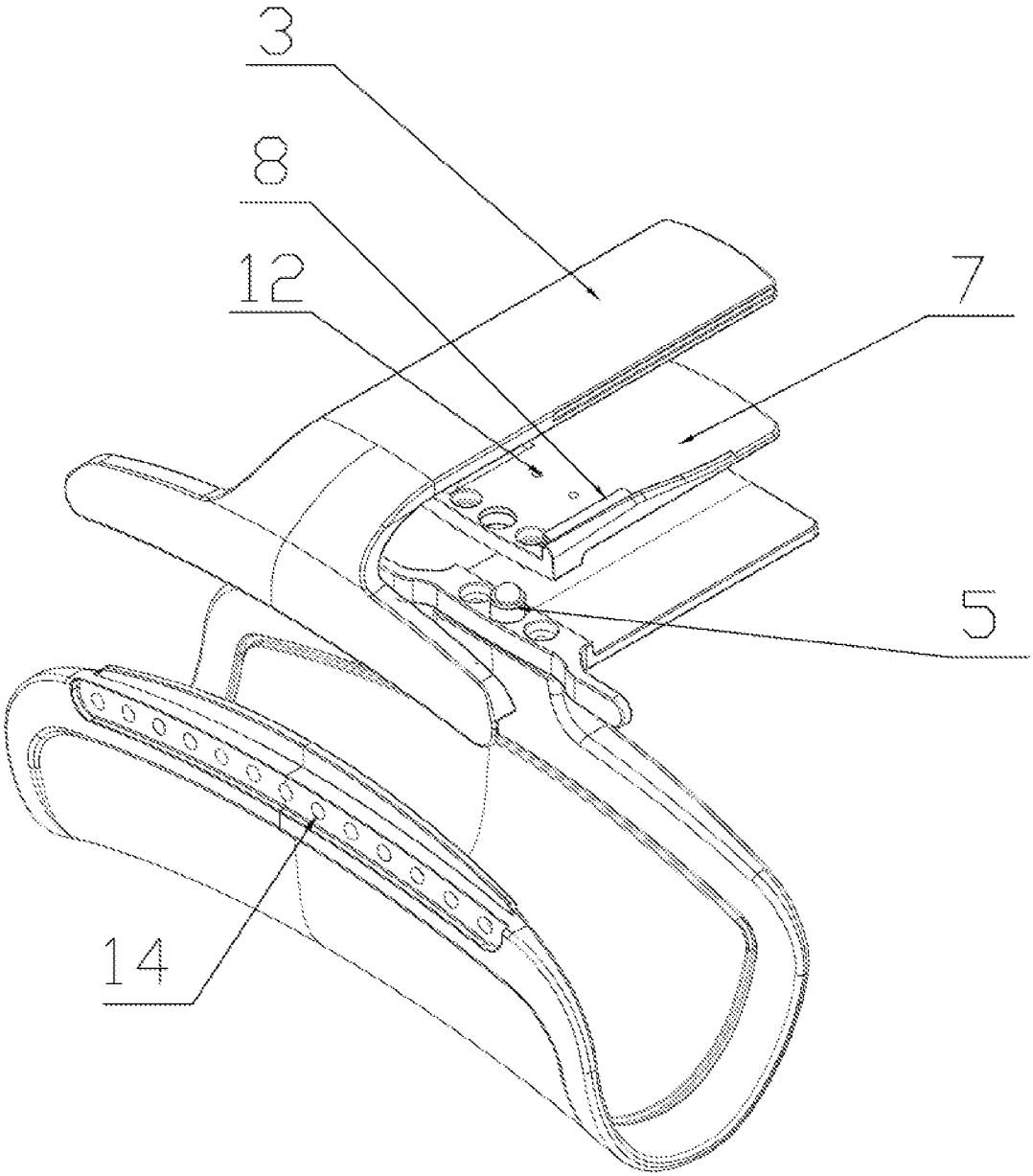
FIG. 3 is the breakdown elevation view of head restraint.
Figure 4:
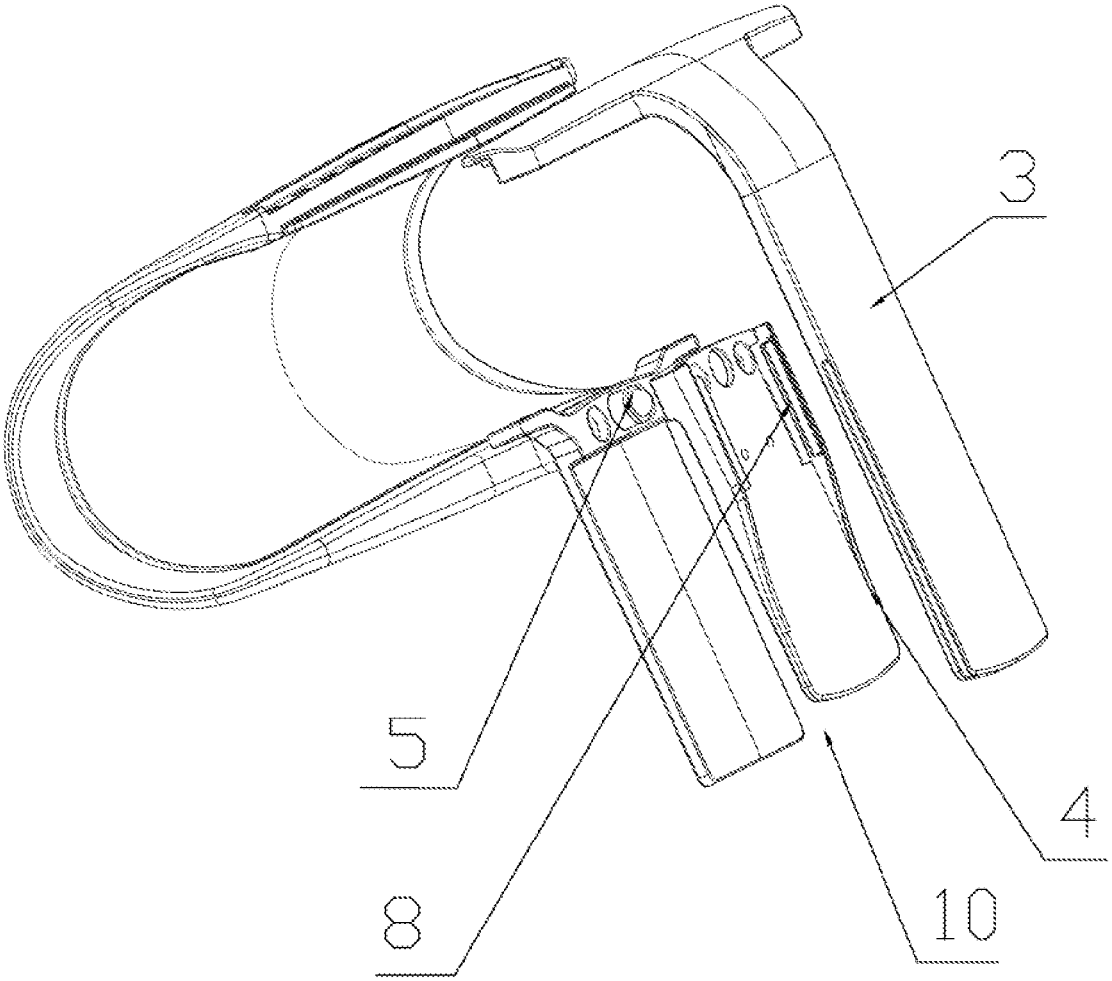
FIG. 4 is the breakdown elevation view of head restraint.
Figure 5:
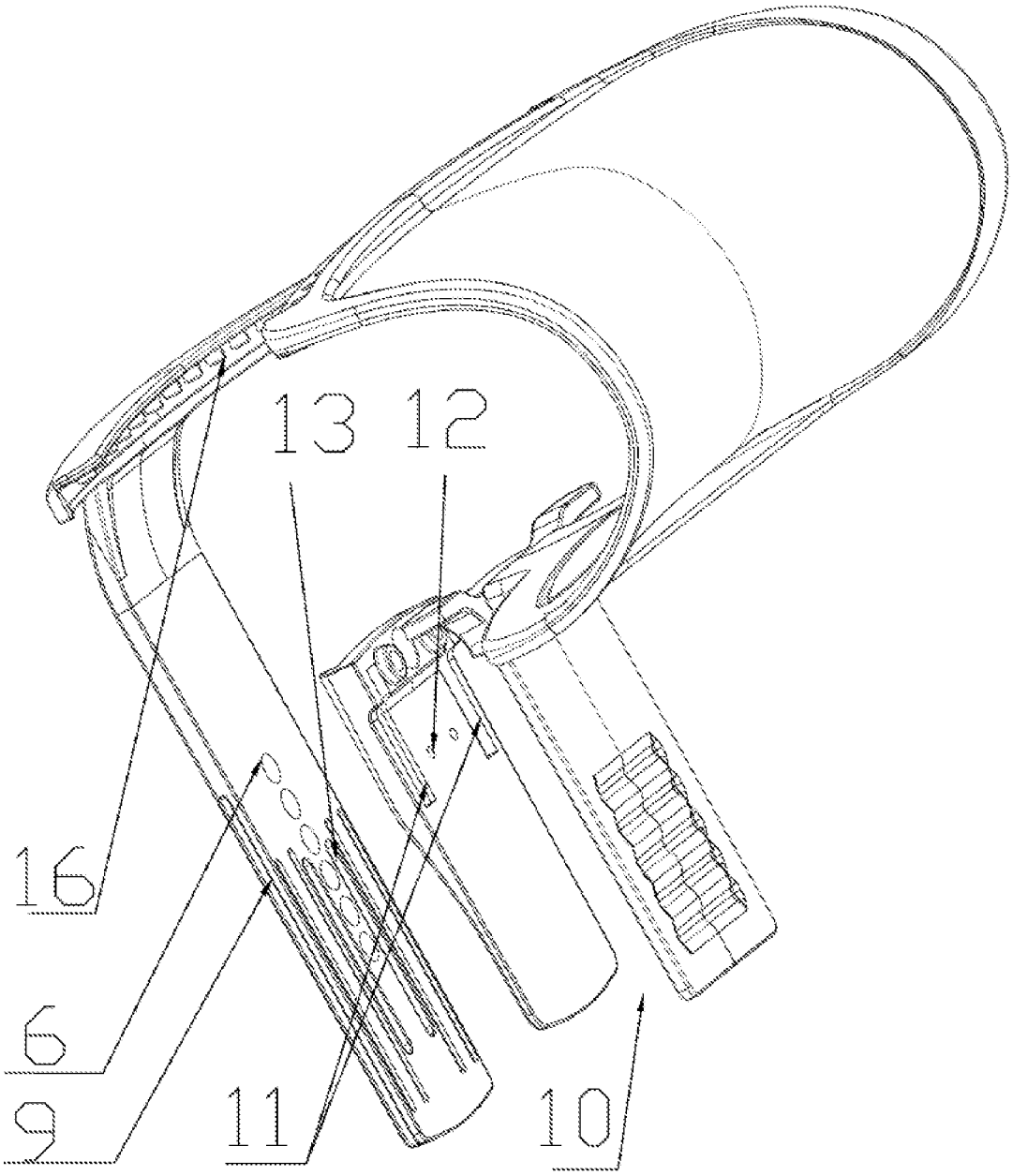
FIG. 5 is the breakdown elevation view of head restraint.

As shown in FIG. 1-FIG. 5, the head restraint comprises: a first bracket 1, a second bracket 3, and an elastic pillow back 2 arranged side by side. The first bracket 1 is connected to one side of the elastic pillow back 2, and the second bracket 3 is connected to the other side of the elastic pillow back 2. The elastic pillow back 2 is made of soft plastic, which is elastically stretchable, giving a cushioned and comfortable feeling to the relying head. The first bracket 1 or/and the second bracket 3 is/are fixed on the chair back (not shown in the figure), and the height of elastic pillow back 2 can be adjusted by adjusting the height of the entire chair back. The first bracket 1 is fixed on the chair back, the second bracket 3 can slide relative to the first bracket 1 and adjust the length and expansion of the elastic pillow back 2, so as to meet the requirements for the comfort of head restraint for people of different heights and different levels.

In this embodiment, the materials of the elastic pillow back 2 include PVC, ABS, lead stearate, thermoplastic polyurethane elastomer, photocatalyst, nano-silver and compatibilizer, wherein the PVC is used as the main material of soft plastics, and ABS is used as an auxiliary material to adjust the hardness of PVC. These two materials are diluted with a compatibilizer to form a mixture. The proportions of the PVC, ABS, lead stearate, thermoplastic polyurethane elastomer, photocatalyst, nano-silver and compatibilizer are 1:0.1:0.45:2:0.01:0.2:3 respectively.

The manufacturing method of the above-mentioned elastic pillow back 2 is as follows: I. Put 1 portion of PVC, 0.1 portion of ABS and 3 portions of compatibilizer into a blender and stir to form a mixture. In this embodiment, the compatibilizer can be maleic anhydride graft, which mainly includes maleic anhydride graft ABS (AB S-g-MAH), maleic anhydride graft PE (PE-g-MAH), maleic anhydride graft PP (PP-g-MAH), maleic anhydride graft PS (SMA), etc. The compatibilizing mechanism of this type of compatibilizer is that the maleic anhydride group in the compatibilizer is esterified with the terminal hydroxyl group of the PC resin to form a graft, which can link PVC and ABS through chemical bonds to fuse them and adjust the properties of each other; add 2 portions of thermoplastic polyurethane elastomer to the above mixture. The thermoplastic polyurethane elastomer has high modulus, high growth rate, high elasticity and polarity, which can improve the elasticity of the entire mixture. It can stick with ABS through strong polarity to neutralize the hardness of ABS and make the mixture present a controllable state of tension and relaxation; add 0.45 portion of lead stearate and 0.01 portion of photocatalyst to the mixture formed in step 2. Photocatalyst can kill bacteria. It is a general term for a photo-semiconductor material with photocatalytic function represented by nanoscale titanium dioxide. Under the action of ultraviolet and visible light, it produces a strong catalytic degradation effect: it can effectively degrade toxic and harmful gases in the air; kill a variety of bacteria, and decompose and harmlessly treat toxins released by bacteria or fungi; meanwhile, it also has such functions as removing formaldehyde, deodorization, anti-fouling, and purifying air, preventing the elastic pillow back 3 from being easily moldy. The lead stearate is used as a stabilizer for PVC, and its molecular formula is C36H70O4Pb, wherein the lead can provide a positive electrode for the nano-silver in the next step, generating a cell reaction and increasing the adsorption of nano-silver; plate the outside of the mixture formed in step 3 with nano-silver and finally form the shape. The particle size of nano-silver is mostly around 25 nanometers. It has strong inhibitory and killing effects on dozens of pathogenic microorganisms such as *Escherichia coli, Neisseria gonorrhoeae*, and *Chlamydia trachomatis*, and does not produce drug resistance, thus increasing the antibacterial and antioxidant properties of the entire elastic pillow back.

In this embodiment, an intermediate bracket 4 is provided between the first bracket 1 and the second bracket 3. The intermediate bracket 4 is fixed on the first bracket 1, the second bracket 3 is slidably connected with the intermediate bracket 4, the first bracket 1 has a fixed tab 5 passing through the intermediate bracket 4, and the second bracket 3 has a row of first through holes 6 to be buckled with the tab 5. A movable slot 7 of the second bracket 3 is provided in the middle of the intermediate bracket 4, two inserted plates 8 are respectively provided on the inner side of the movable slot 7, and the two sides of the second bracket 3 are respectively provided with a movable groove 9 for the inserted plates 8, which can prevent the stroke of the second bracket 3 from deviating during sliding. When the length of the elastic pillow back 2 needs to be adjusted, the second bracket 3 is moved in the movable slot 7, and the tab 5 passes through the surface of the first through hole 6 and enters one of the first through holes 6 to fix the second bracket 3, so as to fix the length of the elastic pillow back 2.

Preferably, the head of the tab 5 is spherical and a spring is provided inside the head to help the tab 5 enter the first through hole 6.

Preferably, an avoidance space 10 is formed between the first bracket 1 and intermediate bracket 4 for engaging the chair back. The intermediate bracket 4 is provided with two parallel slots 11 on the sides of the avoidance space 10, which can be used to fix the chair back.

To support the travel path of the second bracket 3, the intermediate bracket 4 is also provided with two second through holes 12, and the second bracket 4 is provided with a vertical groove 13 corresponding to the second through holes 12 respectively. The chair back passes through the second through hole 12 through the bolts and snaps into the vertical groove 13, which can provide a travel path for the second bracket 4. In combination with the inserted plate 8 and the movable groove 9 above, the travel path is more determined and the service life of the second bracket 4 is increased.

In order to fix the elastic pillow back 2 to the second bracket 3 more stably, three steps 13 are provided in the place where the elastic pillow back 2 is in contact with the second bracket 3. The top of the three steps 13 is provided with a row of clamping slots 14, the elastic pillow back 2 is provided with fitting steps 15 corresponding to the three steps 13, and the ceiling of the fitting steps 15 is provided with a projection 16 corresponding to the clamping slot 14. When the projection 16 enters the clamping slot 14, the top surface of the second bracket 3 and the top surface of the elastic pillow back 2 are straight.

The above embodiments are good practices of the invention; however, the practice of the invention is not restricted by the above embodiments, and any other changes, modifications, replacements, combinations and simplifications within the spirit and principles of the invention shall be regarded as equivalent replacement and included in the protection scope of the invention.

The invention claimed is:

1. A head restraint is characterized by comprising: a first bracket, a second bracket, and an elastic pillow back arranged side by side; the first bracket is connected to one side of the elastic pillow back, and the second bracket is connected to another side of the elastic pillow back; the elastic pillow back is made of soft plastic, and at least one of the first bracket or/and the second bracket is/are fixed on the chair back; wherein the first bracket is fixed on the chair back, and the second bracket slides relative to the first bracket and adjusts a length of the elastic pillow back.

2. The head restraint as claimed in claim 1 is characterized in that three steps are provided in a place where the elastic pillow back is in contact with the second bracket; a top portion of the three steps is provided with a row of clamping slots, the elastic pillow back is provided with fitting steps corresponding to the three steps, and a ceiling of the fitting steps is provided with a projection corresponding to the clamping slot.

3. A head restraint is characterized by comprising: a first bracket, a second bracket, and an elastic pillow back arranged side by side; the first bracket is connected to one side of the elastic pillow back, and the second bracket is connected to another side of the elastic pillow back the elastic pillow back is made of soft plastic, and at least one of the first bracket or the second bracket is fixed on the chair back, where the head restraint is characterized in that materials of the elastic pillow back include PVC, ABS, lead stearate, thermoplastic polyurethane elastomer, photocatalyst, nano-silver and compatibilizer.

4. The head restraint as claimed in claim 3 is characterized in that proportions of the PVC, ABS, lead stearate, thermoplastic polyurethane elastomer, photocatalyst, nano-silver and compatibilizer are 1:0.1:0.45:2:0.01:0.2:3 respectively.

5. The head restraint as claimed in claim 4 is characterized in that a manufacturing method of the elastic pillow back is as follows:

(I) Put 1 portion of PVC, 0.1 portion of ABS and 3 portions of compatibilizer into a blender and stir to form a mixture;

(II) Add 2 portions of thermoplastic polyurethane elastomer to the mixture;

(III) Add 0.45 portion of lead stearate and 0.01 portion of photocatalyst to the mixture formed in step 2;

(IV) Plate an outside portion of the mixture formed in step 3 with nano-silver and finally form the elastic pillow back.

6. A head restraint is characterized by comprising: a first bracket, a second bracket, and an elastic pillow back arranged side by side; the first bracket is connected to one side of the elastic pillow back, and the second bracket is connected to another side of the elastic pillow back the elastic pillow back is made of soft plastic, and at least one of the first bracket or the second bracket is fixed on the chair back, where the head restraint is characterized in that an intermediate bracket is provided between the first bracket and the second bracket; the intermediate bracket is fixed on the first bracket, the second bracket is slidably connected with the intermediate bracket, the first bracket has a fixed tab passing through the intermediate bracket, and the second bracket has the first through holes to be buckled with the tab.

7. The head restraint as claimed in claim 6 is characterized in that a movable slot of the second bracket is provided in a middle portion of the intermediate bracket, two inserted plates are respectively provided on an inner side of the movable slot, and two sides of the second bracket are respectively provided with a movable groove for the inserted plates.

8. The head restraint as claimed in claim 6 is characterized in that an avoidance space is formed between the first bracket and the intermediate bracket for engaging the chair back, and the intermediate bracket is provided with two parallel slots on both sides of the avoidance space; the intermediate bracket is also provided with two second through holes, and the second bracket is provided with a vertical groove corresponding to the second through holes respectively.

9. The head restraint as claimed in claim 6 is characterized in that a head of the tab is spherical, and a spring is provided inside the head.

* * * * *